United States Patent [19]

Failor et al.

[11] Patent Number: 4,949,410

[45] Date of Patent: Aug. 21, 1990

[54] GUARD RAIL FOR PATIENT TRANSPORT APPARATUS HOSPITAL BEDS AND THE LIKE

[75] Inventors: Raymond A. Failor, Seville; Eugene Hayton, Medina; Mark Reuter, Chippewa, all of Ohio

[73] Assignee: Hausted, Inc., Medina, Ohio

[21] Appl. No.: 339,674

[22] Filed: Apr. 18, 1989

Related U.S. Application Data

[62] Division of Ser. No. 166,675, Mar. 11, 1988, Pat. No. 4,858,260.

[51] Int. Cl.[5] ..... A47C 21/08

[52] U.S. Cl. ..... 5/430; 5/425

[58] Field of Search ..... 5/425, 427, 428, 430

[56] References Cited

U.S. PATENT DOCUMENTS

| | | | |
|---|---|---|---|
| 2,101,290 | 12/1937 | Pierson | 5/425 |
| 2,817,854 | 12/1957 | Pratt | 5/428 |
| 2,891,258 | 6/1959 | Reichert | 5/428 |
| 3,069,700 | 12/1962 | Berlin | 5/430 |
| 3,585,659 | 6/1971 | Burst et al. . | |
| 3,855,654 | 12/1974 | Pivacek . | |
| 3,932,903 | 1/1976 | Adams et al. . | |
| 3,955,837 | 5/1976 | Christensen | 5/425 |
| 4,002,330 | 1/1977 | Johansson | 5/428 |
| 4,259,756 | 4/1981 | Pace | 5/425 |
| 4,409,695 | 10/1983 | Johnston et al. | 5/428 |
| 4,509,217 | 4/1985 | Therrien | 5/428 |
| 4,584,728 | 4/1986 | Tabbert et al. | 5/430 |
| 4,612,679 | 9/1986 | Mitchell . | |
| 4,653,129 | 3/1987 | Kuck et al. | 5/430 |
| 4,672,699 | 6/1987 | Goodwin | 5/430 |
| 4,747,171 | 5/1988 | Einsele et al. . | |

FOREIGN PATENT DOCUMENTS

| | | | |
|---|---|---|---|
| 1511654 | 12/1966 | France | 5/428 |

*Primary Examiner*—Gary L. Smith
*Assistant Examiner*—Michael Milano
*Attorney, Agent, or Firm*—Hoffmann & Baron

[57] ABSTRACT

A multi-purpose patient support and transport apparatus is provided which includes a Trendelenburg mechanism and a novel guard rail assembly. The Trendelenburg mechanism is actuated by turning a handle in one direction. This allows a penumatic spring connected between the seat and backrest assemblies to be fully contracted, thereby moving the backrest assembly to a Trendelenburg position. When the handle is turned in the opposite direction, the backrest may also be rotated downwardly, but is precluded from moving beyond the reclining position by a stop member which prevents the pneumatic spring shaft from moving entirely within the spring casing. The guard rail is mounted to the frame of the apparatus by a pair of pivot arms extending at an oblique angle with respect to the plane of the rail. This allows the rail to be stored under the frame when in the lowered position.

17 Claims, 9 Drawing Sheets

GUARD RAIL FOR PATIENT TRANSPORT APPARATUS HOSPITAL BEDS AND THE LIKE

This is a divisional of co-pending application Ser. No. 07/166,675 filed on Mar. 11, 1988 and now U.S. Pat No. 4,858,260.

BACKGROUND OF THE INVENTION

1. Field of the invention

The field of the invention relates to multi-purpose patient transport assemblies, and guard rails for such assemblies and other purposes.

2. Brief description of the prior art

A number of patient transport assemblies have been designed for allowing a patient to be maneuvered between sitting and supine positions. A lever may be employed for converting the unit from a fully upright seating position to any number of semiprone and full prone stretcher positions. Guard rails and/or seat belts are provided for patient safety. Means are also provided for adjusting the height of the unit.

Guard rails are employed in conjunction with patient transport apparatus, hospital beds and related equipment for protecting a patient. The rails may be adjustable between raised and lowered positions to allow access to the patient. U.S. Pat. Nos. 3,081,463, 3,585,659, 3,839,753, 3,855,564, and 3,932,903 disclose guard rails which have been used in the medical industry.

SUMMARY OF THE INVENTION

The invention is directed to a chair/stretcher assembly having a seat portion, a backrest portion pivotably mounted near one side of the seat portion, and a leg rest portion pivotably mounted near the opposite side of the seat portion. Locking means are provided for allowing the backrest position to be maintained in any of a multitude of positions, including a horizontal position substantially coplanar with the seat portion, or in a Trendelenburg position. The locking means preferably includes an extensible assembly such as a pneumatic spring, which is pivotably mounted between the backrest portion and the unit's seat portion or frame assembly. The extensible assembly is fully extended when the backrest is in the upright position. It contracts as the backrest is lowered to the horizontal position. Stop means are provided for preventing further contraction of the extensible member when the backrest reaches the horizontal position. The stop means are movable to allow further contraction of the extensible member, thereby allowing the backrest to assume the Trendelenburg position.

The guard rail according to the invention includes a rail pivotably mounted to the frame of the unit by a pair of connecting members. At least one of the connecting members includes a notch and a pair of openings therein. One of the openings receives a pivot pin used for connecting the rail to the frame. A spring-loaded pin is also mounted to the frame. Means are provided for retracting this pin. When the rail is in the raised position, the spring-loaded pin moves within the second of the two openings within the connecting member, thereby maintaining the rail in this position. Retraction of the pin allows the rail to swing about the axes of the pivot pins to the lowered position. Movement of the pin into the notch locks the rail in this position. The connecting members preferably extend obliquely with respect to the rail to allow it to be stored under the seat portion when in the lowered position.

DETAILED DESCRIPTION OF THE INVENTION

Figure 1:
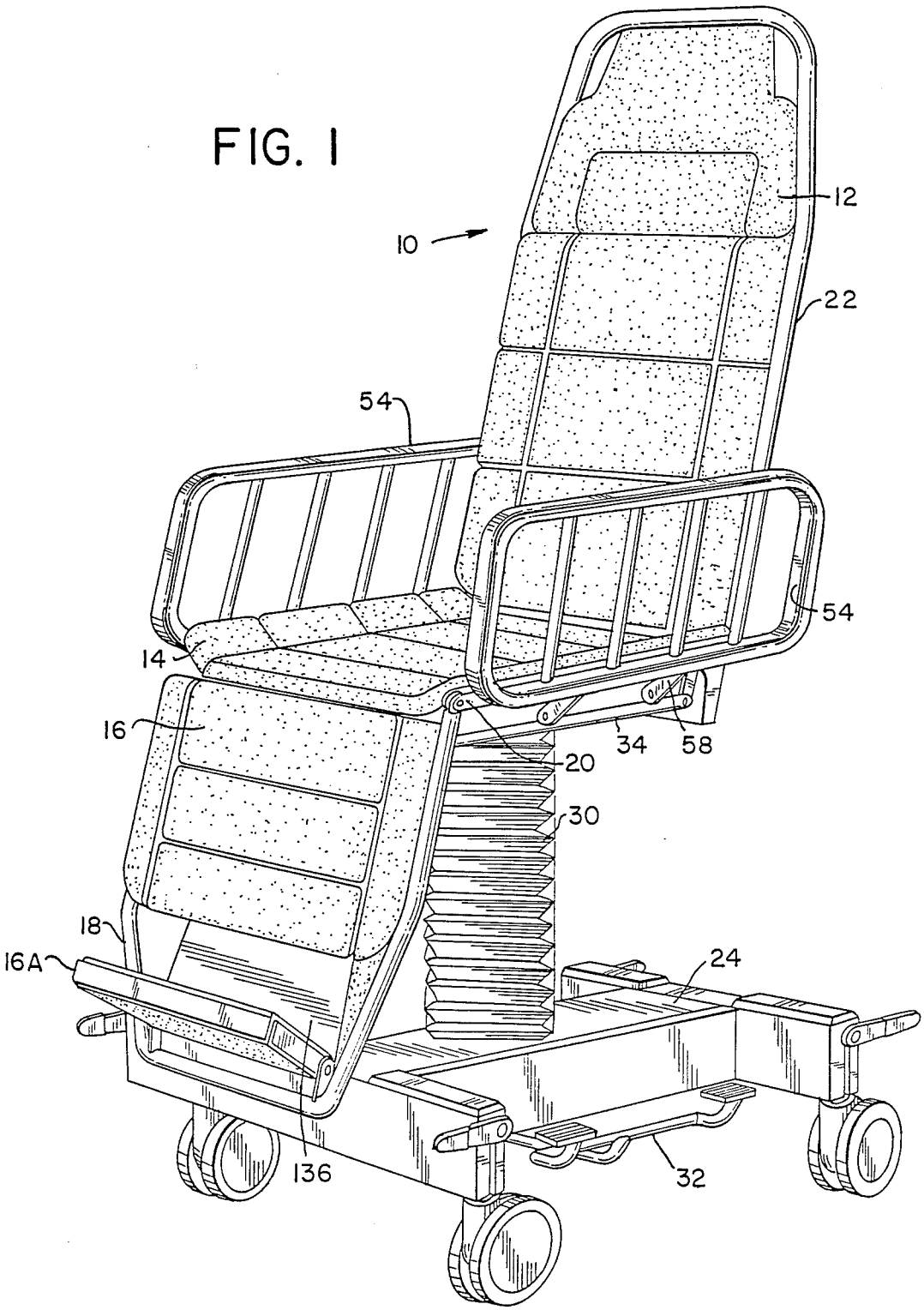
FIG. 1 is a perspective view of a chair/stretcher assembly in accordance with the invention.

A chair/stretcher assembly 10 is provided for transporting a patient in the seated position or the supine position. The assembly includes a backrest portion 12, a seat portion 14, and a leg supporting portion 16. The leg supporting portion includes a tubular steel frame 18 which is pivotably mounted to a seat portion frame 20. A footrest 16A is pivotably mounted to a pair of mounting tabs 18A. A backrest frame 22 is also pivotably mounted to the seat portion frame. A steel channel U-shaped frame 22A is pivotably mounted to the backrest frame 22 and is used as a push bar when transporting the assembly.

The seat portion is mounted to a mobile base 24 having a four wheel brake and steer caster system which is adjustable by means of a set of levers 26. A column 28 supports the seat portion. Hydraulic height adjustment means (not shown) are positioned within a polymeric casing 30. The casing 30 is formed as a bellows to allow the column to increase or decrease in height upon actuation of the hydraulic adjustment means. Foot pedal assemblies 32 mounted to each side of the unit are used to control height adjustment.

Figure 5:
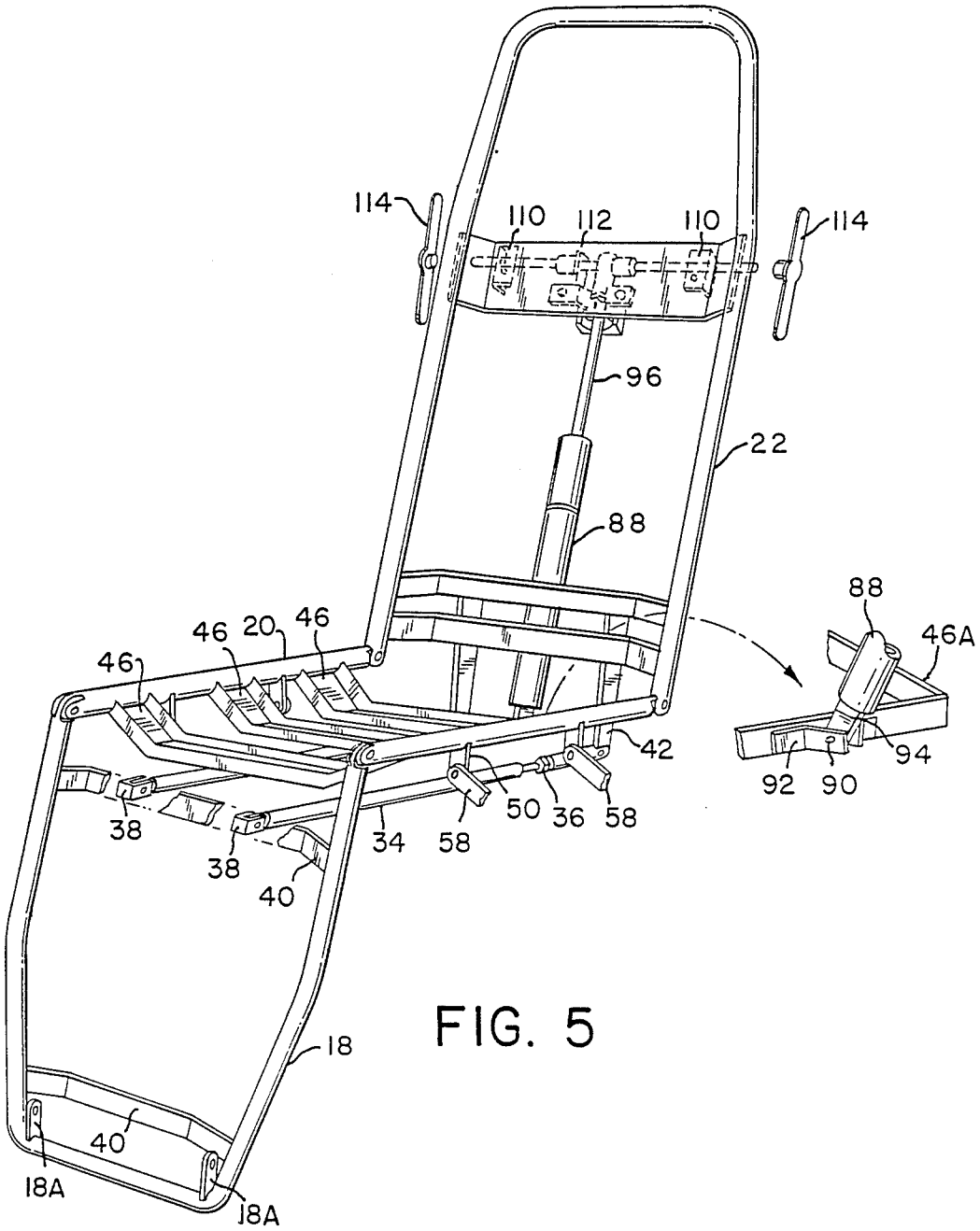
FIG. 5 a perspective view of a frame assembly and related mechanical components of the chair/stretcher assembly.

A linkage assembly as shown in FIG. 5 connects the three frames 18, 20, 22 and causes the backrest portion 12 to remain either substantially parallel to or coplanar with the leg supporting portion 16 at all times. It includes a pair of connecting links 34, each having a threaded section with a jam nut 36. By loosening the jam nut, one section of the connecting link may be rotated with respect to the other, thereby increasing or decreasing its length. The nut is tightened once the length is properly adjusted.

The connecting links 34 are pivotably connected at one end to a pair of brackets 38. The brackets are mounted to one of the cross members 40 secured to the leg supporting frame 18. The opposite ends of the links are pivotably secured to a pair of supports 42 which are in turn mounted to a pair of cross members 44. The cross members 44 extend laterally between opposing lower portions of the backrest frame 22.

A plurality of U-shaped cross members 46 extend laterally between each tube defining the seat frame 20.

A rearwardly extending U-shaped member 46A is mounted to the rear cross member 46. A seat cushion 48 is mounted to a plate supported by the cross members 46. A pair of downwardly extending projections 50 welded to each seat frame tube are used for mounting a pair of guard rail assemblies 52.

Each guard rail assembly includes a metal rail 54 having a rubber or polymeric bumper 56 secured thereto. A pair of pivot arms 58 extend at an oblique angle with respect to the plane defined by each rail. These arms are positioned between the downwardly extending projections 50 of the seat frame 20. Threaded holes 60 within the seat frame projections are aligned with a set of unthreaded holes 62 in the guard rail arms. A pair of partially threaded screws 64 extend through each of the holes 62 and are secured to the threaded holes 60. Each rail assembly is thereby pivotably secured to the seat frame 20.

Figure 11:
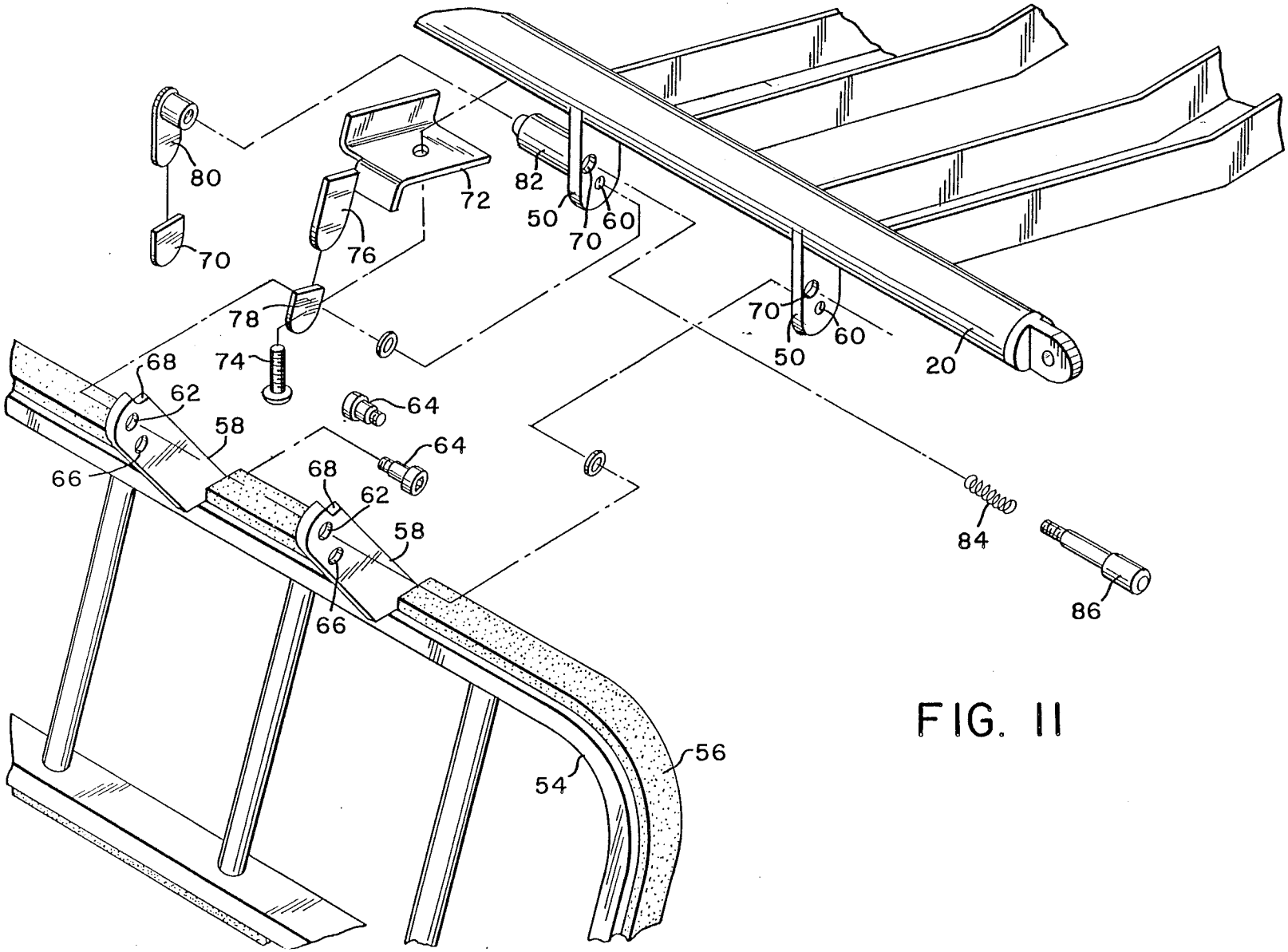
FIG. 11 is an exploded, perspective view of the guard rail mounting assembly.

Each pivot arm 58 includes a pin-receiving hole 66 therein as well as a notch 68 defined in the end surface thereof as best shown in FIG. 11. The pin-receiving holes 66 are aligned with corresponding pin-receiving holes 70 in the seat frame projections 50 when the rail assembly is in the fully raised position as shown in FIG. 1.

A stationary trigger plate assembly 72 is secured to the seat frame by a screw 74. This assembly includes a flat trigger projection 76 having a polymeric cover 78 mounted thereto. A mobile trigger plate 80 having a similar cover 78 includes a cylindrical extension projection from one end thereof. The extension includes a threaded axial bore. One of each pair of the seat frame projections 50 includes a cylindrical housing 82 having an unthreaded axial bore aligned with the unthreaded opening 70 therein. A spring 84 is positioned within the housing 82. A plunger 86 having a threaded end extends through the spring and housing, and is threadably engaged to the threaded axial bore within the mobile trigger plate 80. The spring 84, which bears against an end well of the cylindrical housing 82 and a shoulder defined by the plunger 86, resiliently urges the plunger towards one of the rail projections.

The non-threaded end of the plunger 86 is positioned within one 66 of the two holes within the pivot arms 58 when the rail assembly 52 is in the fully raised position. It thereby locks the rail in this position. The plunger 86 is withdrawn from the hole by moving the mobile trigger towards the stationary trigger assembly 72. As the rail assembly swings downwardly, the plunger bears against the surface of the rail projection 58 until the rail arm is vertically oriented. It then moves within the notch 68 to lock the rail assembly in the lowered position. The spring 84 maintains the plunger 86 within the notch 68 until the trigger mechanism is again actuated. Due to the orientation of the arms 58 with respect to the rail assembly 52, the rail assembly is positioned beneath the seat portion 14 when in the fully lowered position and a distance from the seat portion when fully raised.

Referring now to FIGS. 5–10, a mechanism for adjusting the positions of the backrest portion 12 relative to the seat portion 14 is illustrated in detail. The mechanism allows the assembly to assume the fully reclined position shown in FIG. 4 or the Trendelenburg position wherein the backrest portion defines an obtuse angle with respect to the seat portion.

A pneumatic spring assembly 88 is pivotably mounted to the seat section 46A of the assembly 10 by a hinge pin 90. The pin extends through a pair of fixed pivot ears 92 and an opening in the base 94 of the pneumatic spring assembly.

The pneumatic spring 88 includes a shaft 96 that extends from the cylindrical casing thereof. An actuating rod 98 extends from this shaft. Movement of the rod 98 towards the shaft 96 "unlocks" the shaft and allows it to be moved in either direction with respect to the pneumatic spring casing. The rod 98 is normally positioned in opposing relation to a flat notch 100 defined in a rod member of a Trendelenburg handle assembly 102. A second handle assembly 104 is colinear with the first assembly 102. Each extends within a handle connector 106 and is secured thereto by a spring pin 108. This arrangement provides the effect of a solid shaft. Each handle assembly is rotatable within one of a pair of support angles 110 mounted to the upper backrest cross member 112. A pair of labelled handles 114 are secured to the ends of the handle assemblies. One end of each handle may include indicia stating "recline" and the other end indicating "Trendelenburg". The purpose of such labelling will be apparent when the operation of the assembly is further described.

Figure 8:
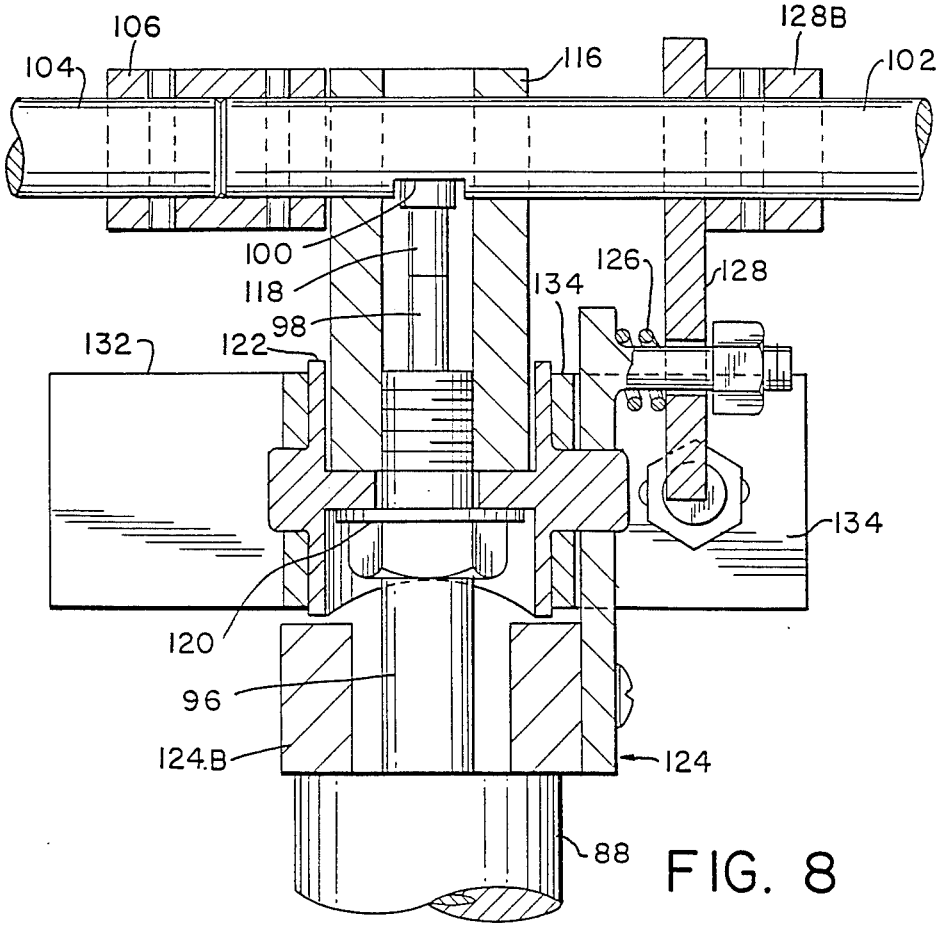
FIG. 8 is a sectional, elevation view thereof.
Figure 7:
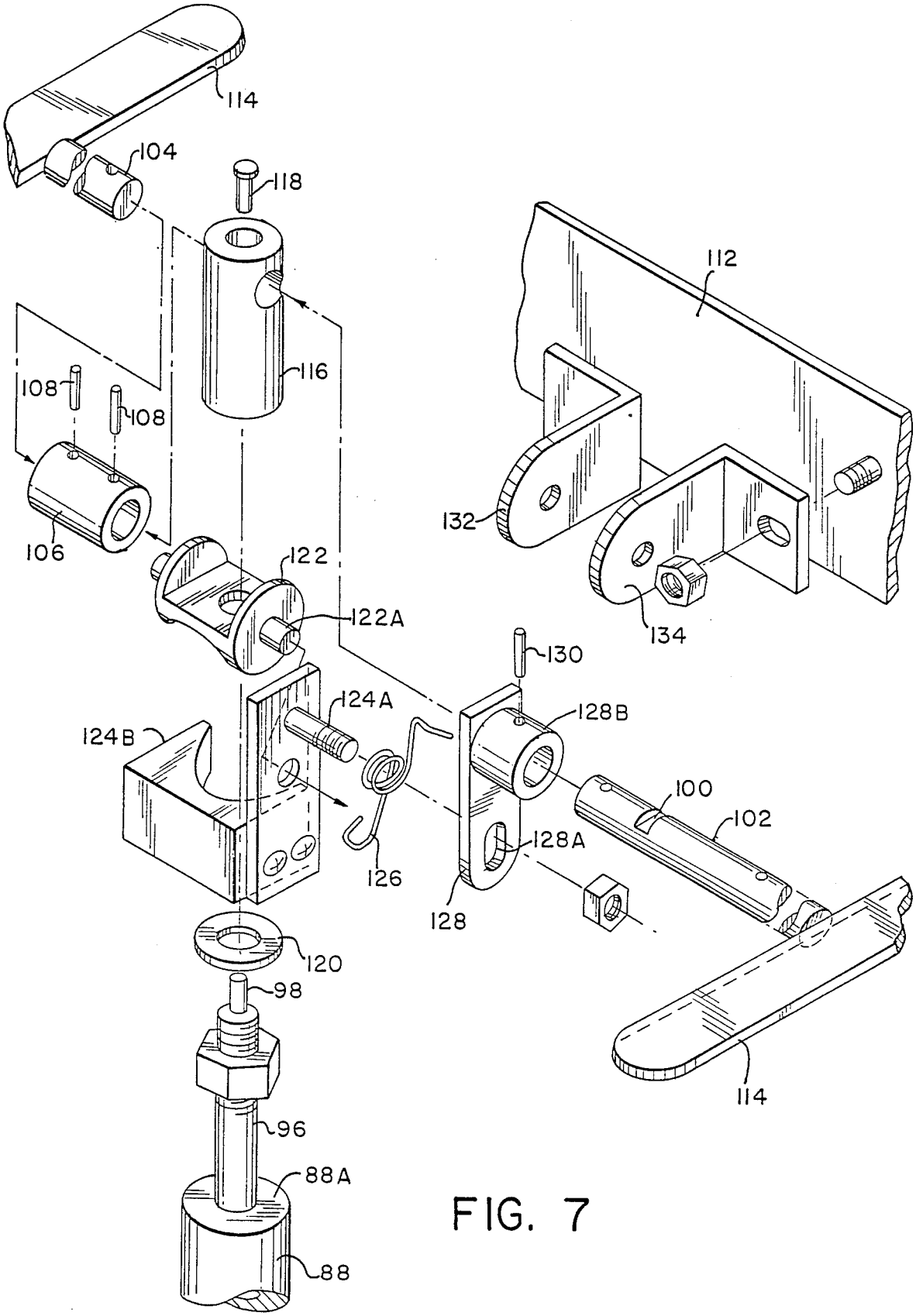
FIG. 7 is an exploded, perspective view of the backrest positioning assembly.

A pneumatic spring trigger chamber 116 is threadably secured to the end of the spring shaft 96. An actuator pin 118 is positioned within the chamber 116 between the actuating rod 98 and the flat notch 100 of the first handle assembly 102. A lock washer 120 and spring pivot 122 fit over the spring shaft 96. A stop block assembly 124 includes an opening through which a cylindrical projection 122A of the spring pivot extends. The stop block assembly is accordingly pivotable with respect thereto. A lateral projection 124A having a threaded end extends from the stop block. A release spring 126 is mounted to the projection 124A. The release spring is hooked on one end to the stop block 124 and on an opposite end to a trigger plate assembly 128. The trigger plate assembly includes a plate having an elongate opening 128A and a cylindrical projection 128B extending from the plate portion thereof. A spring pin 130 extends through an opening in the cylindrical projection 128B to secure the trigger plate assembly to the Trendelenburg handle assembly 102. A first pivot ear 132 is secured to cross member 112, and a portion thereof extends between the spring pivot 122 and stop block 124. The lateral projections 122A, 122B of the spring pivot 122 extend, respectively, through openings in the first pivot ear 132 and a second pivot ear 134, as shown in FIG. 8.

Figure 2:
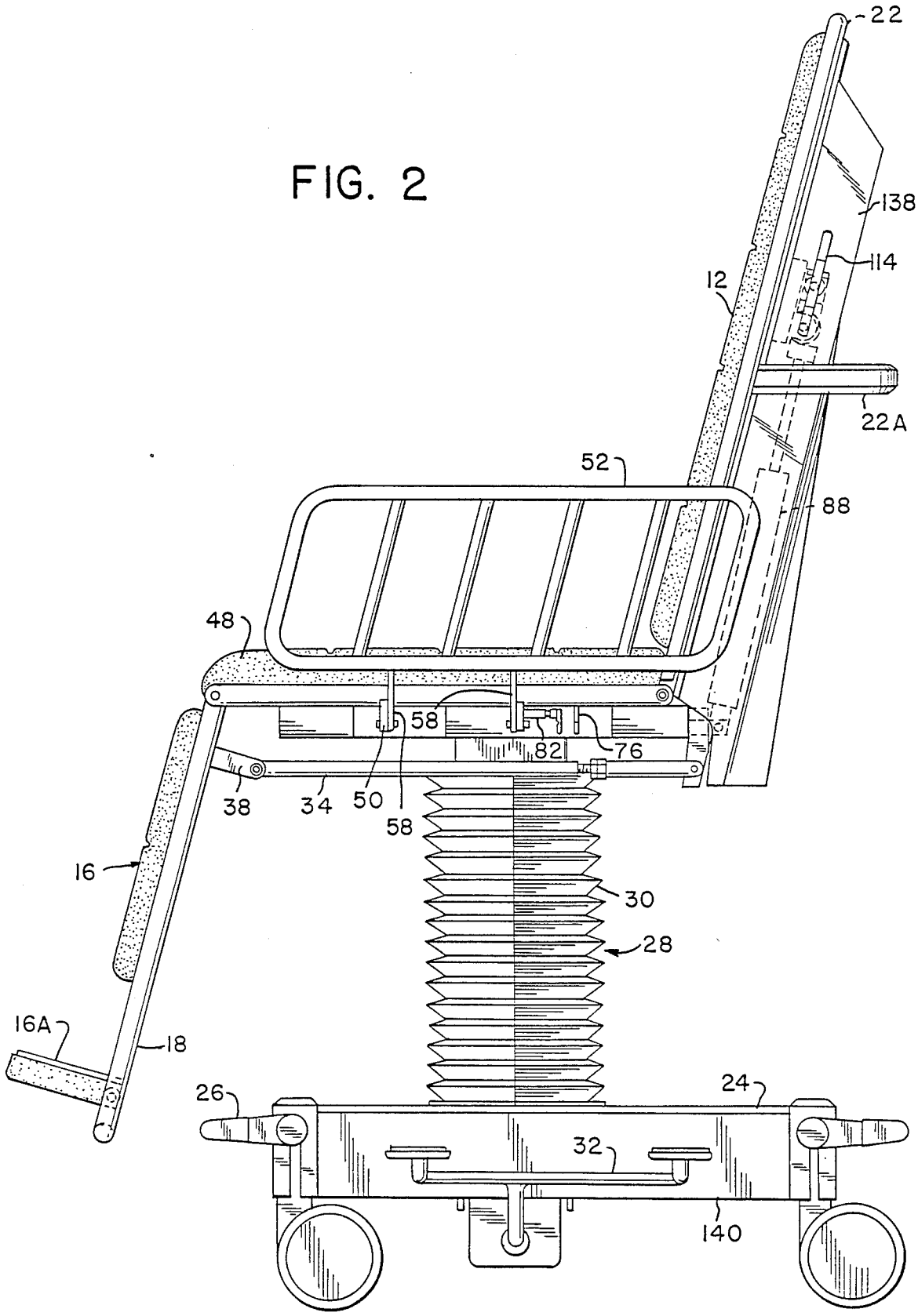
FIG. 2 is a side elevation view thereof.
Figure 3:
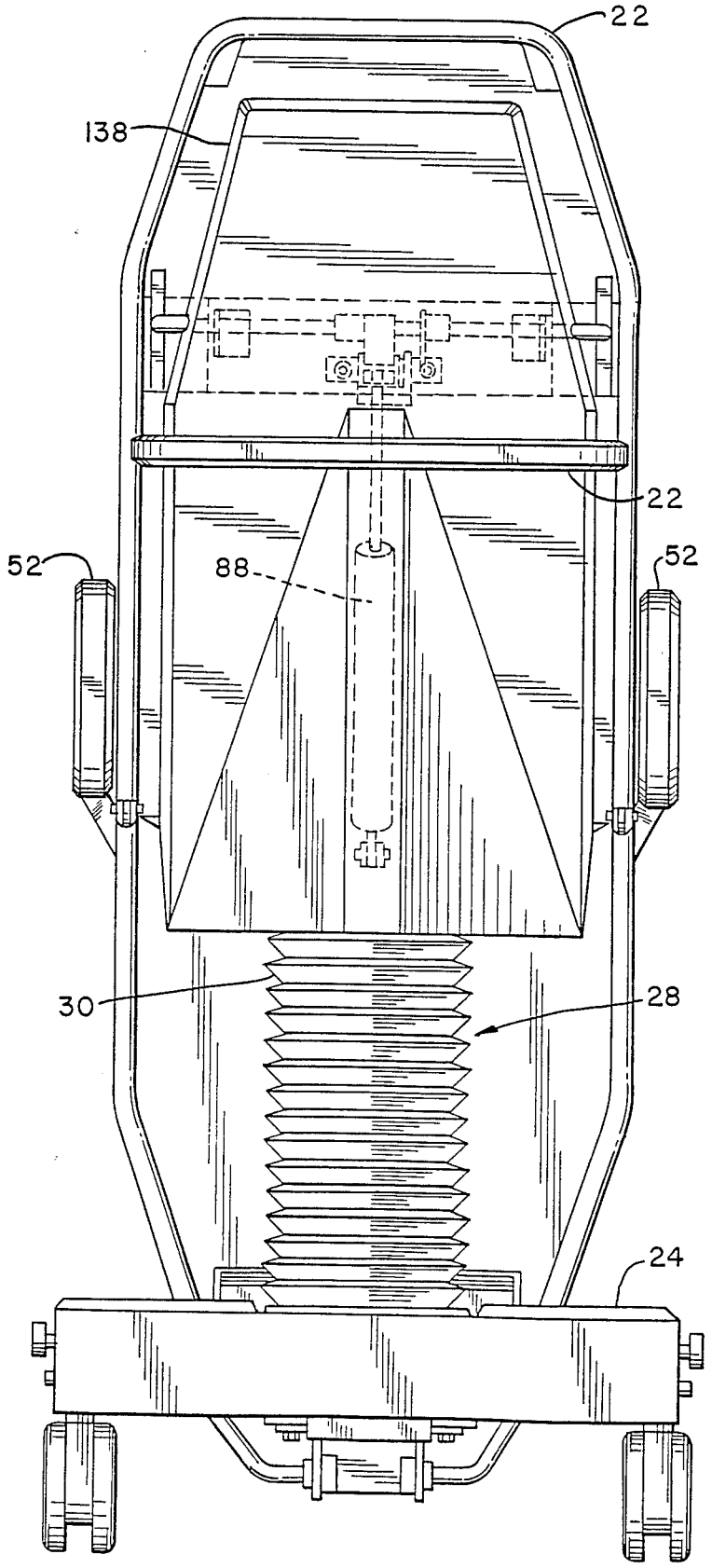
FIG. 3 is a rear elevation view thereof.
Figure 4:
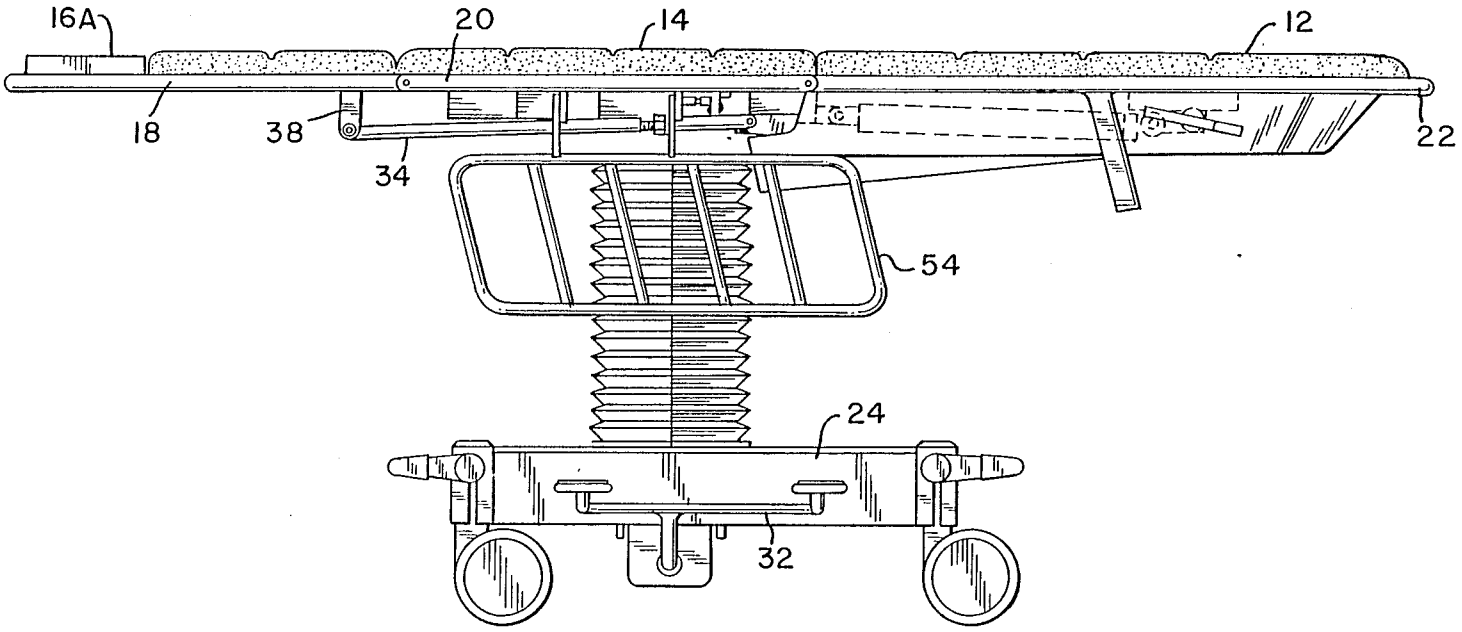
FIG. 4 is a side elevation view thereof showing the assembly as employed as a stretcher.
Figure 6:
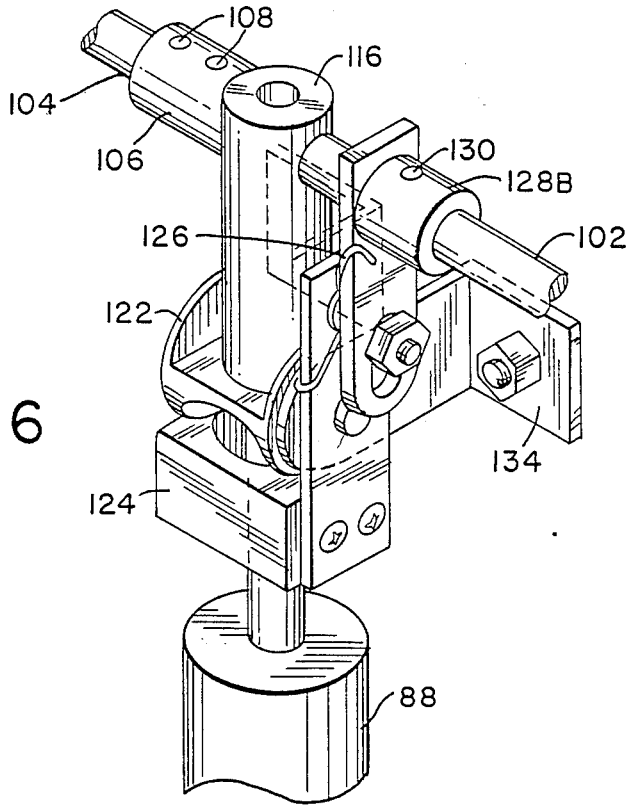
FIG. 6 is a perspective view of a portion of a backrest positioning assembly, according to the invention.
Figure 9:
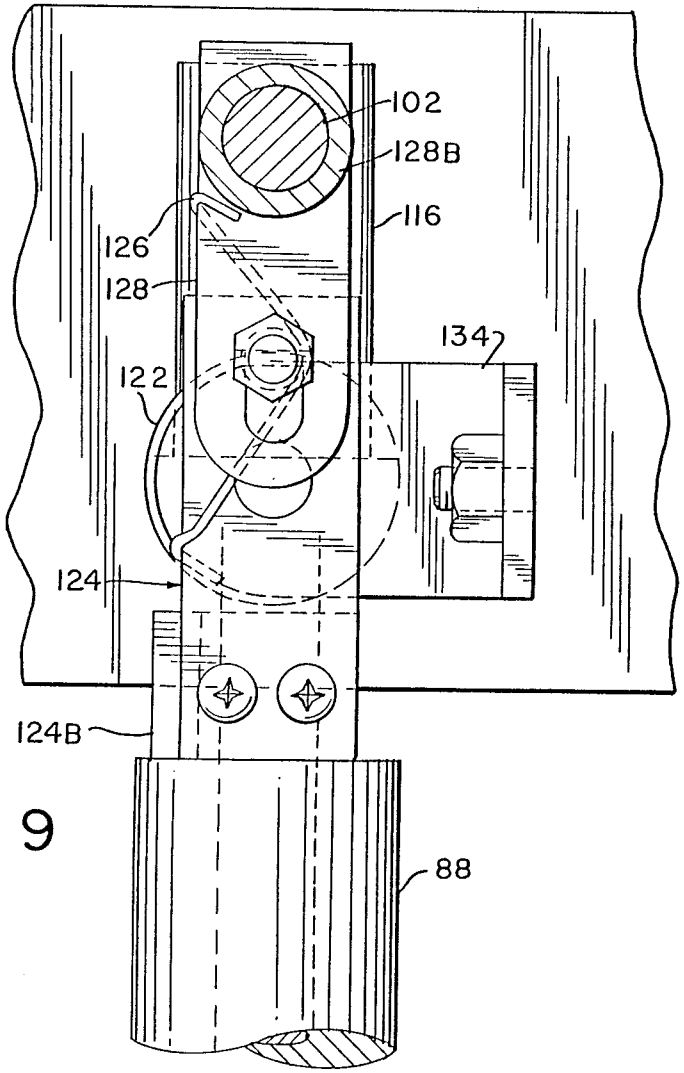
FIG. 9 is a side elevation view thereof.

The backrest adjusting mechanism allows the backrest portion 12 to be moved from the relatively upright position shown in FIG. 2 to any number of positions, including a horizontal orientation as shown in FIG. 4, or a Trendelenburg position where the backrest portion is lower than the seat portion 14. In most backrest positions, the stop block 124 is oriented such that the spring shaft 96 extends through a semi-cylindrical slot within a plastic block portion 124B thereof. FIGS. 6 and 9 show the block portion 124B in this position. The stop block is urged towards the shaft 96 by the release spring 126.

The backrest portion is moved to the recline position by turning one of the two ends of handles 114 in a first rotational direction, e.g. towards the back of chair/-stretcher assembly. The rod portion 102 (or 104) of the handle assembly is accordingly rotated such that the flat notch 100 is displaced and the actuator pin 118 pushed towards the actuating rod 98. Compression of the pneumatic spring actuating rod 98 allows the shaft 96 to move further within the spring casing as the backrest portion 12 rotates downwardly with respect to the seat portion. The pneumatic spring 88 urges the backrest portion at a controlled speed towards the reclined position when actuated. When the upper surface of the fully reclined spring casing abuts the lower surface of the stop block 124 as shown in FIG. 8, further downward rotational movement of the backrest portion is precluded.

Figure 10:
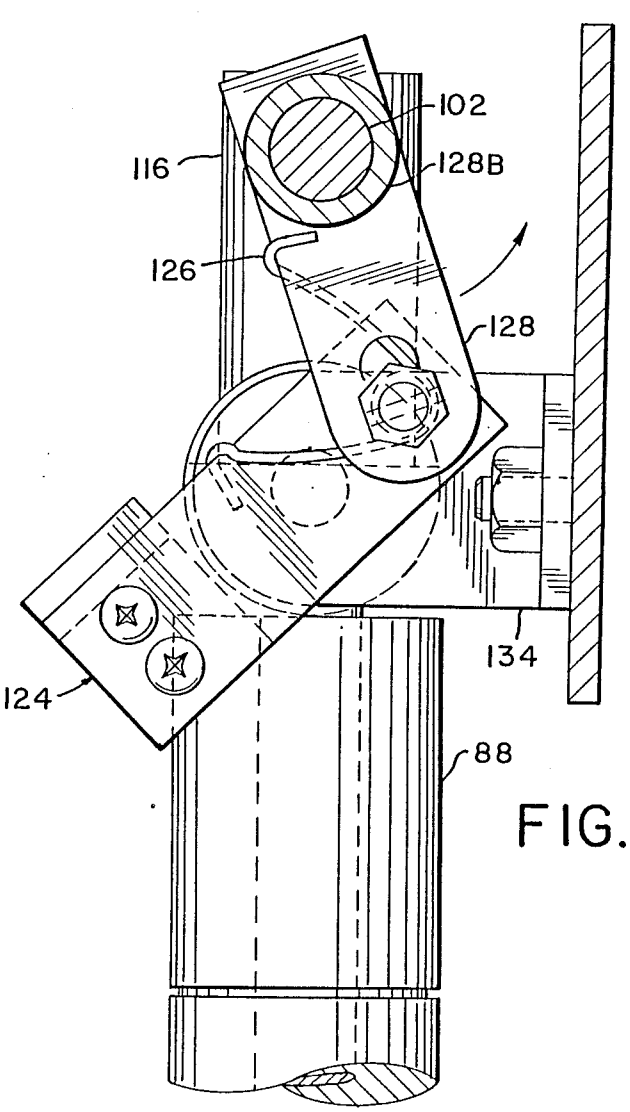
FIG. 10 is a side elevation view thereof showing said assembly when in the Trendelenburg position.

To provide further compression of the pneumatic spring 88, thereby allowing the backrest position 12 to move beyond a horizontal orientation and into, for example, a ten degree Trendelenburg position, the other of the two ends of handle 114 is rotated towards the back of the chair/stretcher assembly. Rotation of shaft 102 (or 104) in this direction causes the trigger plate assembly 128 to rotate about the shaft 102. The stop block 124, being pivotable about the lateral projection 122A of the spring pivot 122, is urged away from the pneumatic spring shaft 96 as a force is exerted upon projection 124A by the trigger plate assembly 128. This allows the shaft 96 to move further within the spring casing than when the handle 114 is turned in the opposite direction as the stop block 124 does not contact the pneumatic spring casing. The shaft 96 is free to move an additional distance equal to the height of the plastic block portion 124B until the upper surface 88A of the pneumatic spring casing contacts the lower surfaces of the pivot ears 132,134. In the preferred embodiment of the invention, this distance corresponds to approximately a ten degree rotation below horizontal of the backrest assembly. FIG. 10 illustrates the positions of the stop block 124, trigger plate assembly 128, and pneumatic cylinder casing when the backrest is in a Trendelenburg position.

The upper surfaces of the back, seat and leg frames are covered with steel panels 136, one of which is partially exposed in FIG. 1. The panels are covered with contoured, vinyl-covered foam cushions attached to all sections with hook and loop type fasteners. The base frame and rear portion of the backrest are covered with formed plastic covers 138, 140 that provide a smooth, seamless covering for most of the hardware described above.

It will be appreciated by those skilled in the art that the chair/stretcher assembly 10 disclosed herein may be used for a number of functions. In the chair position, it may be used as a conventional mobile chair. The assembly may also be used as a recovery apparatus, such as a stretcher, an examination table, or other device due to its height adjustability in any position from chair to stretcher. Minor surgery, such as ophthalmic cataract removal, can be performed in a stretcher position to a semireclined position without moving the patient from the apparatus. In summary, the chair/stretcher assembly allows a medical facility to admit patients, move them to an examining or treatment area, prep, treat and transport them to a recovery or discharge area, all with a single piece of equipment.

What is claimed is:

1. A patient support apparatus comprising:

a frame assembly defining a patient support plane;

a pair of plate-like pivot arms pivotably mounted to said frame assembly, said pivot arms being pivotable about an axis, each of said pivot arms including at least one substantially flat side;

a guard rail assembly secured to said pivot arms, said guard rail defining a second plane; said second plane being substantially perpendicular to said patient support plane when said guard rail is in a fully raised position, said axis running substantially parallel to said patient support plane and said second plane; and said pivot arms extending from said guard rail at an oblique angle with respect to said second plane, whereby said guard rail is positioned a distance from said frame assembly when in a raised position and beneath said frame assembly when in a lowered position;

said frame assembly including a horizontally extending frame member, a pair of plate-like projections extending downwardly from and fixedly secured directly to said frame member, each of said plate-like projections including at least one substantially flat side, said substantially flat sides of said plate-like projections adjoining, respectively, said substantially flat sides of of said pivot arms;

means for pivotably mounting said pair of pivot arms to said pair of projections;

means for locking said guard rail in said fully raised position; and means for locking said guard rail in said lowered position.

2. A patient support apparatus as defined in claim 1 wherein at least one of said projections includes an opening therein, at least one of said pivot arms includes an opening therein, a locking pin mounted to said frame assembly and opposing at least one of said openings, said openings being in alignment when said guard rail is in a first selected position, thereby allowing said locking pin to be inserted through both openings to lock the guard rail in said selected position.

3. A patient support apparatus as defined in claim 2 wherein at least one of said pivot arms includes a second pin-receiving portion, said second pin-receiving portion being in alignment with said opening within one of said projections when said guard rail is in a second selected position.

4. A patient support apparatus as defined in claim 3 wherein said second pin-receiving portion is a notch defined in an end surface of said pivot arm.

5. A guard rail assembly for a patient transport apparatus or the like, comprising:

a frame; said frame including a horizontally extending frame member, a projection fixedly secured to and extending downwardly from said frame member, said projection including a substantially flat surface and first and second holes extending therethrough;

a guard rail;

a pivot arm fixedly secured to said guard rail and pivotably secured to said projection, said pivot arm being oriented with respect to said guard rail such that said guard rail is rotatable between an upright position wherein it is at least partially positioned above said frame and spaced away from said frame and a stored position wherein it is positioned below and under said frame;

said pivot arm including a substantially flat surface and first and second holes extending therethrough, said flat surface of said pivot arm adjoining said flat surface of said projection;

a pivot member extending through said respective first holes of said projection and pivot arm, thereby pivotably securing said pivot arm to said projection;

said respective second holes of said projection and pivot arm being aligned when said guard rail is in a first selected rotational position; and means for locking said guard rail in said first selected rotational position, said locking means including a locking pin, said locking pin being aligned with at least one of said respective second holes.

6. An assembly as defined in claim 5 wherein said pivot arm extends at an oblique angle with respect to said guard rail.

7. An assembly as defined in claim 5 including means for automatically locking said guard rail when in said upright position.

8. An assembly as defined in claim 7 including means for automatically locking said guard rail when in said stored position.

9. An assembly as defined in claim 5 including a second projection fixedly secured to and extending downwardly from said frame, and a second pivot arm fixedly secured to said guard rail and pivotably secured to said second projection.

10. An assembly as defined in claim 9 wherein each of said pivot arms extends at an oblique angle with respect of said guard rail.

11. A guard rail assembly as defined in claim 5 wherein said pivot arm includes an end surface and a notch defined within said end surface, said notch being aligned with said second hole within said projection when said guard rail is in a second selected rotational position.

12. A guard rail assembly as defined in claim 5 wherein said projection and said pivot arm both have plate-like configuration.

13. A guard rail assembly as defined in claim 5 including a housing mounted to said projection, said housing including a bore aligned with said second hole within said projection, said locking pin being positioned within said bore.

14. A guard rail assembly as defined in claim 13 including a stationary trigger plate secured to said frame, said stationary trigger plate including a trigger projection, and a mobile trigger plate positioned at least partially in opposing relation to said trigger projection and secured to said locking pin.

15. A patient support apparatus as defined in claim 1 wherein said pair of pivot arms are positioned between said pair of projections.

16. A patient support apparatus as defined in claim 2 including a housing mounted to one of said projections, said housing including a bore aligned with said opening within said one of said projections, said locking pin being at least partially positioned within said bore.

17. A patient support apparatus as defined in claim 16 including a stationary trigger plate secured to said frame assembly, said stationary trigger plate including a trigger projection, and a mobile trigger plate positioned at least partially in opposing relation to said trigger projection and secured to said locking pin.

* * * * *